US008441246B2

(12) United States Patent
Hong

(10) Patent No.: US 8,441,246 B2
(45) Date of Patent: May 14, 2013

(54) TEMPERATURE INDEPENDENT REFERENCE CURRENT GENERATOR USING POSITIVE AND NEGATIVE TEMPERATURE COEFFICIENT CURRENTS

(75) Inventor: Seung-Hun Hong, Namyangju-si (KR)

(73) Assignee: Dongbu Hitek Co., Ltd., Seoul (KR)

( * ) Notice: Subject to any disclaimer, the term of this patent is extended or adjusted under 35 U.S.C. 154(b) by 716 days.

(21) Appl. No.: 12/634,218

(22) Filed: Dec. 9, 2009

(65) Prior Publication Data

US 2010/0156387 A1 Jun. 24, 2010

(30) Foreign Application Priority Data

Dec. 24, 2008 (KR) ..... 10-2008-0132840

(51) Int. Cl.
*G05F 3/16* (2006.01)

(52) U.S. Cl.
USPC ..... 323/315; 323/907

(58) Field of Classification Search ..... 323/312, 323/315, 907
See application file for complete search history.

(56) References Cited

U.S. PATENT DOCUMENTS 5,686,825 A * 11/1997 Suh et al. ..... 323/316
6,002,244 A * 12/1999 Wrathall ..... 323/315
6,133,718 A * 10/2000 Calafato et al. ..... 323/312
6,177,788 B1 * 1/2001 Narendra et al. ..... 323/315
6,351,111 B1 * 2/2002 Laraia ..... 323/315
6,522,117 B1 * 2/2003 Young et al. ..... 323/315
6,819,093 B1 * 11/2004 Kay ..... 323/315
6,891,358 B2 * 5/2005 Marinca ..... 323/316
6,958,597 B1 * 10/2005 Lin et al. ..... 323/313
7,301,321 B1 * 11/2007 Uang et al. ..... 323/313
7,411,380 B2 * 8/2008 Chang et al. ..... 323/314
7,472,030 B2 * 12/2008 Scheuerlein ..... 702/99
7,486,065 B2 * 2/2009 Lin et al. ..... 323/313
7,495,426 B2 * 2/2009 Tran et al. ..... 323/315
8,330,445 B2 * 12/2012 Herbst ..... 323/313
2010/0156387 A1 * 6/2010 Hong ..... 323/315

* cited by examiner

*Primary Examiner* — Jeffrey Sterrett
(74) *Attorney, Agent, or Firm* — Sherr & Jiang, PLLC

(57) ABSTRACT

A temperature independent type reference current generating device and methods thereof. A temperature independent type reference current generating device may include a first reference current generator generating a first reference current having a first element decreasing according to a temperature, a second reference current generator generating a second reference current having a second element increasing according to the temperature, and/or mirroring and outputting a second reference current and/or a mirrored second reference current. A temperature independent type reference current generating device may include a first current mirror mirroring a first reference current and/or outputting a mirrored first reference current, and a second current mirror adding a mirrored first reference current and a mirrored second reference current, and/or mirroring a result of an addition to output a mirrored result as an output reference current.

8 Claims, 3 Drawing Sheets

TEMPERATURE INDEPENDENT REFERENCE CURRENT GENERATOR USING POSITIVE AND NEGATIVE TEMPERATURE COEFFICIENT CURRENTS

The present application claims priority under 35 U.S.C. 119 to Korean Patent Application No. 10-2008-0132840 (filed on Dec. 24, 2008) which is hereby incorporated by reference in its entirety.

BACKGROUND

Embodiments relate to an electronic circuit and methods thereof. Some embodiments relate to a temperature independent type reference current generating device.

Figure 1:
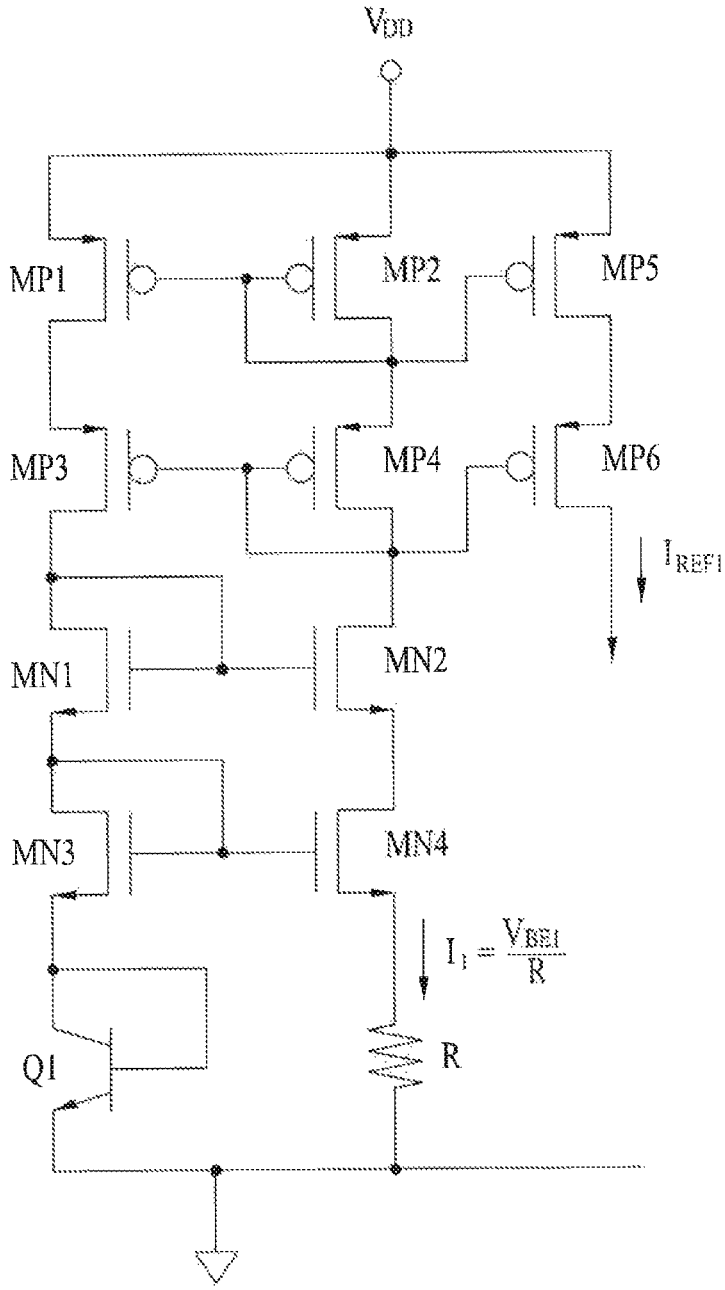
FIG. 1 (Related Art)
Figure 2:
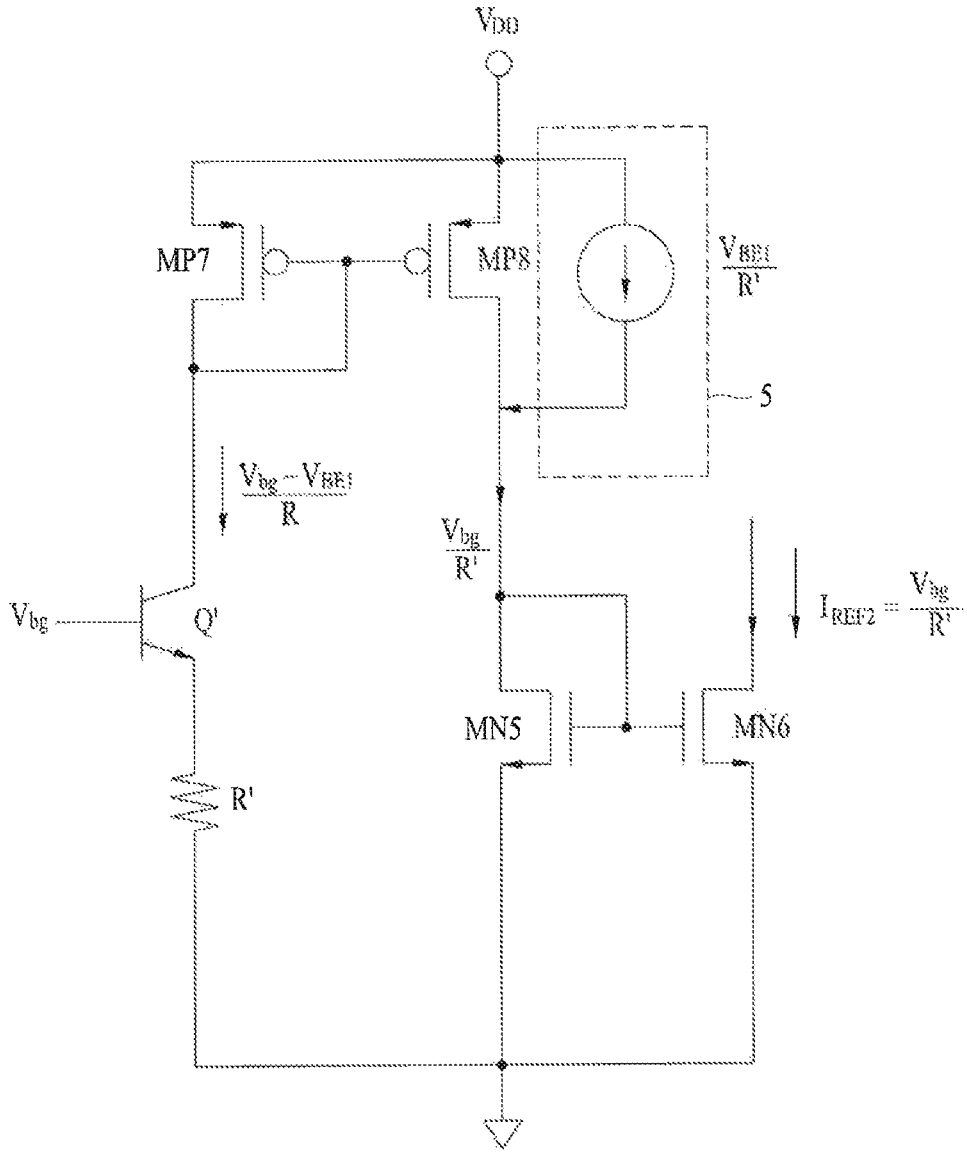
FIG. 2 (Related Art)

A reference current generator and/or a reference current source may supply a reference current that may not be influenced by power and/or temperature. A generated reference current may be radiated and/or supplied to a bias voltage of each circuit. Example FIG. 1 and FIG. 2 are diagrams illustrating circuits of a current source. Referring to FIG. 1, a current source may generate reference current $I_{REF1}$ using base/emitter voltage $V_{BE}$ and resistance R1. A current source may generate a current, for example $I_1=V_{BE1}/R1$, with substantially no influence of supplied power $V_{DD}$. However, $V_{BE1}$ may be influenced by temperature and thus a value of reference current $I_{REF1}$ generated from a current may vary according temperature.

Referring to FIG. 2, a current source may use a reference voltage with substantially no influence of temperature. A current source may generate reference current $I_{REF2}$ ($[V_{bg}-V_{BE1}]/R'$) using reference voltage $V_{bg}$, bipolar transistor Q' and resistance R'. However, $V_{BE1}$ may be influenced by temperature, and thus a temperature compensation part 5 may be provided to compensate for an influenced value. A current source may generate reference current $I_{REF2}$ with no influence of power and/or temperature. However, a reference voltage source circuit generating reference voltage $V_{bg}$ may be additionally provided in a current source to generate reference current $I_{REF2}$. Therefore, a current source may be influenced by a temperature change and/or may require a reference voltage source circuit to generate a reference voltage.

Accordingly, there is a need of a temperature independent type reference current generating device, and a method of manufacturing a temperature independent type reference current generating device, which may be able to generate a reference current substantially without influence of a temperature and/or a supply voltage, substantially independent from a reference voltage.

SUMMARY

Embodiments relate to a temperature independent type reference current generating device, and a method of manufacturing a temperature independent type reference current generating device. According to embodiments, a temperature independent type reference current generating device may be provided. In embodiments, a temperature independent type reference current generating device may be able to generate a reference current substantially without influence of a temperature and/or a supply voltage, substantially independent from a reference voltage.

According to embodiments, a temperature independent type reference current generating device may include a first reference current generator generating a first reference current having a first element using a first bipolar transistor and/or a first load. In embodiments, a temperature independent type reference current generating device may include a first element decreasing according to a temperature. In embodiments, a temperature independent type reference current generating device may include a second reference current generator generating a second reference current having a second element increasing according to a temperature, which may mirror and/or output a second reference current.

According to embodiments, a temperature independent type reference current generating device may include a first current mirror mirroring a first reference current and/or outputting a mirrored first reference current. In embodiments, a temperature independent type reference current generating device may include a second current mirror adding a mirrored first reference current and a mirrored second reference current, and/or mirroring a result of an addition to output a mirrored result as an output reference current.

According to embodiments, a reference current may be generated using a bipolar transistor and/or a load. In embodiments, a reference current may be generated, substantially without influence of changes of temperature and/or supply power, and/or substantially independent from a reference voltage.

DRAWINGS

Example FIG. 1 to FIG. 2 are circuit views illustrating a current source.

Figure 3:
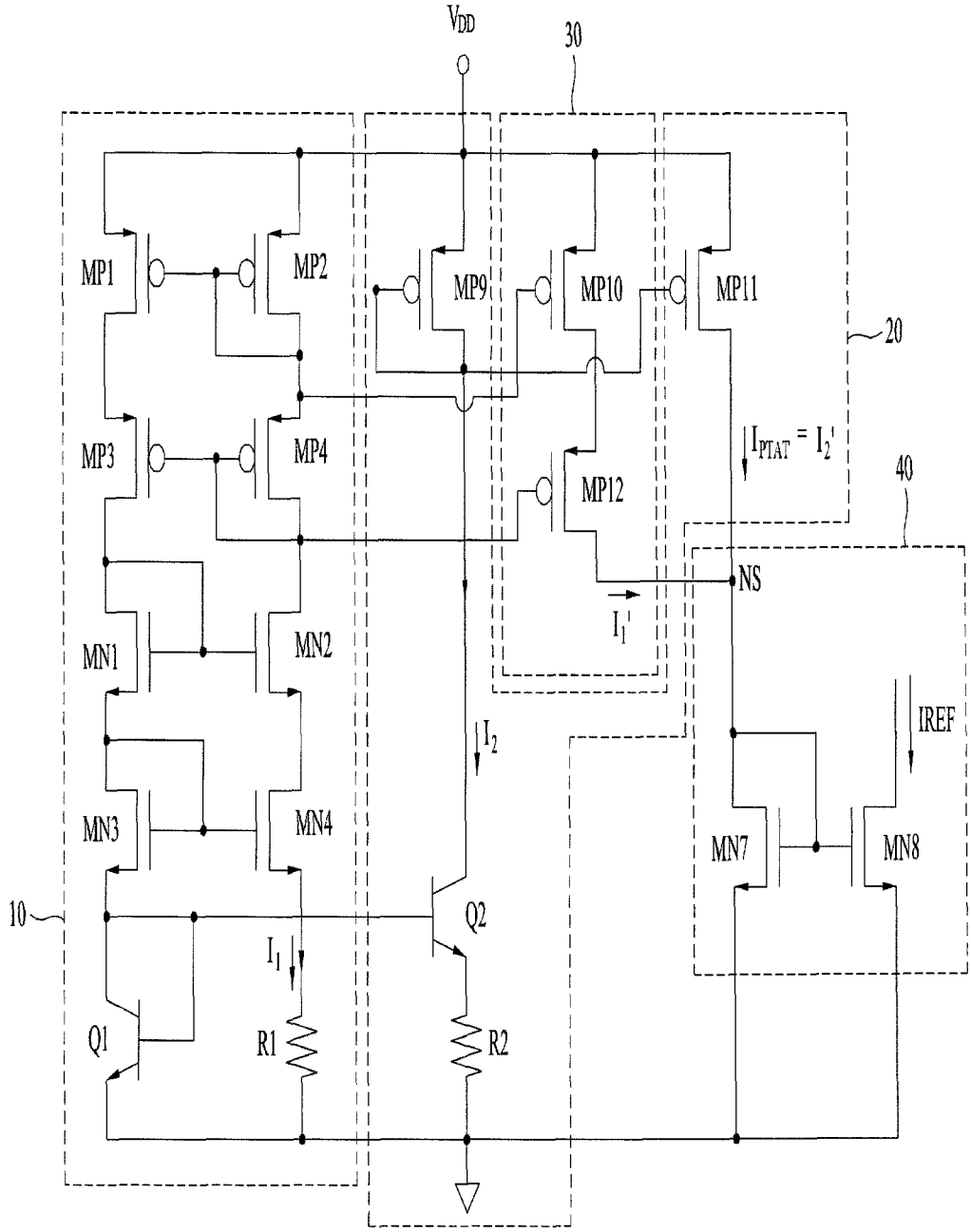

Example FIG. 3 is a circuit view illustrating a temperature independent type reference current generating device in accordance with embodiments.

DESCRIPTION

Embodiments relate to a temperature independent type reference current generating device and methods thereof. Referring to example FIG. 3, a circuit illustrates a temperature independent type reference current generating device in accordance with embodiments. According to embodiments, a reference current generating device may include first reference current generator 10 and/or second reference current generator 20. In embodiments, a reference current generating device may include first current mirror 30 and/or second current mirror 40.

According to embodiments, first reference current generator 10 may generate first reference current I1 using first bipolar transistor Q1 and/or a first load. In embodiments, first reference current I1 may include a first element that may be variable according to temperature. In embodiments, first reference current generator 10 may include first to fourth PMOS transistors MP1, MP2, MP3 and/or MP4, respectively. In embodiments, first reference current generator 10 may include first to fourth NMOS transistors MN1, MN2, MN3 and/or MN4, respectively. In embodiments, first bipolar transistor Q1 and resistance R1 may be employed as a first load.

According to embodiments, first PMOS transistor MP1 may have a source connected to supply voltage $V_{DD}$. In embodiments, second PMOS transistor MP2 may have a source connected to supply voltage $V_{DD}$, and/or a gate/drain connected to a gate of first PMOS transistor MP1. In embodiments, third PMOS transistor MP3 may have a source connected to a drain of first PMOS transistor MP1. In embodiments, fourth PMOS transistor MP4 may have a source connected to a drain of second PMOS transistor MP2 and a gate/drain connected to each other.

According to embodiments, first NMOS transistor MN1 may have a source/gate connected to a drain of third PMOS transistor MP3. In embodiments, second NMOS transistor MN2 may have a source connected to a drain of fourth PMOS transistor MP4 and/or a gate connected to a gate of first NMOS transistor MN1. In embodiments, third NMOS transistor MN3 may have a source/gate connected to a drain of first NMOS transistor MN1. In embodiments, fourth NMOS transistor MN4 may have a source connected to a drain of second NMOS transistor MN2 and/or a gate connected to a gate of third NMOS transistor MN3.

According to embodiments, first bipolar transistor Q1 may have a base/collector connected to a drain of third NMOS transistor MN3 and/or an emitter connected to a ground. In embodiments, resistance R1 which may be a first load may be connected between a drain of fourth NMOS transistor MN4 and a ground, and/or first reference current I1 may flow along resistance R1. In embodiments, first reference current generator 10 may include the above-described configuration. In embodiments, first reference current I1 may be generated as illustrated by Equation 1. In embodiments, $V_{BE1}$ may be a first element decreasing according to temperature as base/emitter voltage of first bipolar transistor Q1.

$$I_1 = \frac{V_{BE1}}{R1} \qquad \text{EQUATION 1}$$

According to embodiments, second reference current generator 20 may generate second reference current I2 having a second element increasing according to temperature, which may mirror second reference current I2 to output mirrored second reference current I2'. In embodiments, the term mirror may reference a current which may be radiated in a current mirror. In embodiments, second reference current generator 20 may include fifth PMOS transistor MP9, sixth PMOS transistor MP11, second bipolar transistor Q2 and/or resistance R2 corresponding to a second load.

According to embodiments, fifth PMOS transistor MP9 may have a source connected to the supply voltage $V_{DD}$. In embodiments, second bipolar transistor Q2 may have a collector connected to a gate/drain of fifth PMOS transistor MP9 and/or a base connected to a base of first bipolar transistor Q1. In embodiments, resistance R2 which may be a second load may be connected between an emitter of second bipolar transistor Q2 and a ground. In embodiments, sixth PMOS transistor MP11 may have a source connected to supply voltage $V_{DD}$, a gate connected to a gate/drain of fifth PMOS transistor MP9 and/or a drain connected to second current mirror 40. In embodiments, second reference current generator 20 may have the above-described configuration, and/or second reference current I2 may be generated as illustrated by Equation 2.

$$I_2 = \frac{(V_{BE1} - V_{BE2})}{R2} \qquad \text{EQUATION 2}$$

According to embodiments, $V_{BE2}$ may be a base/emitter voltage of second bipolar transistor Q2 and/or second reference current I2' mirrored by a drain of sixth PMOS transistor MP11. In embodiments, mirrored second reference current I2' may be a proportional to absolute temperature (PTAT) current. In embodiments, a second element increasing according to temperature in second reference current I2 may be $V_{BE1}-V_{BE2}$.

According to embodiments, first current mirror 30 may mirror first reference current I1 and/or output mirrored first reference current I1' to second current mirror 40. In embodiments, first current mirror 30 may include seventh PMOS transistor MP10 and/or eighth PMOS transistor MP12. In embodiments, seventh PMOS transistor MP10 may have a gate connected to a drain of second PMOS transistor MP2 and/or a source connected to supply voltage $V_{DD}$. In embodiments, eighth PMOS transistor MP12 may have a source connected to a drain of seventh PMOS MP10, a gate connected to a drain of fourth PMOS transistor MP4 and/or a drain connected to second current mirror 40. In embodiments, mirror first reference current I1' may flow via a drain of eighth PMOS transistor MP12.

According to embodiments, second current mirror 40 may add mirrored first reference current I1' and mirrored second reference current I2', and/or mirror a result of addition to generate output reference current $I_{REF}$. In embodiments, second current mirror 40 may include fifth NMOS transistor MN7 and/or sixth NMOS transistor MN8. In embodiments, fifth NMOS transistor MN7 may have a source/gate connected to a result of addition of mirrored first reference current I1' and mirrored second reference current I'2, and/or a drain connected to a ground. In embodiments, sixth NMOS transistor MN8 may have a gate connected to a gate of fifth NMOS transistor MN7, a source having an output reference current $I_{REF}$ flowing therein and/or a drain connected to a ground. In embodiments, an output reference current flowing via sixth NMOS transistor MN8 may be generated as illustrated by Equation.

$$IREF = I_1' + I_2' = \frac{V_{BE1}}{R1} + \frac{(V_{BE1} - V_{BE2})}{R2} \qquad \text{EQUATION 3}$$

According to embodiments, Equation 3 may be presentable in Equation 4.

$$IREF = \frac{1}{R1}\left[V_{BE1} + (V_{BE1} - V_{BE2})\frac{R2}{R1}\right] \qquad \text{EQUATION 4}$$

According to embodiments, $I_{REF}$ may include $I_{PTAT}$ presentable in Equation 5.

$$(V_{BE1} - V_{BE2})\frac{R2}{R1} \qquad \text{EQUATION 5}$$

According to embodiments, as illustrated in Equation 4, a level of second element $V_{BE1}-V_{BE2}$ may be adjustable by R2/R1 to offset second element $V_{BE1}-V_{BE2}$ of mirrored second reference current I2' and/or first element $V_{BE1}$ of mirrored first reference current I1'. In embodiments, a value of second load R2 may be adjusted to offset the first element and/or the second element to each other. In embodiments, in contrast to a reference current generating device illustrated in FIG. 2, a temperature independent type reference current generating device in accordance with embodiments may generate reference current $I_{REF}$ substantially independent from reference voltage $V_{bg}$. In embodiments, in contrast to a reference current generating device illustrated in FIG. 1, embodiments may offset second element $V_{BE1}-V_{BE2}$ of current $I_{PTAT}$ generated using second reference current generator 20 and first element $V_{BE1}$ of first reference current I1 generated using both first bipolar transistor Q1 and resistance R1 each other, which may compensate for an influence of temperature applied to $V_{BE1}$.

It will be obvious and apparent to those skilled in the art that various modifications and variations can be made in the embodiments disclosed. Thus, it is intended that the disclosed embodiments cover the obvious and apparent modifications and variations, provided that they are within the scope of the appended claims and their equivalents.

What is claimed is:

1. An apparatus comprising:

a first reference current generator generating a first reference current comprising a first element decreasing according to a temperature;

a second reference current generator generating a second reference current comprising a second element increasing according to the temperature, configured to mirror said second reference current and output a mirrored second reference current;

a first current mirror configured to mirror said first reference current and output a mirrored first reference current; and a second current mirror configured to add said mirrored first reference current and said mirrored second reference current, and mirror addition result and output a mirrored addition result as an output reference current.

2. The apparatus of claim 1, wherein said second reference current reference generator is configured to adjust a level of said second element to offset said second element and said first element.

3. The apparatus of claim 1, comprising a temperature independent type reference current generating device.

4. The apparatus of claim 1, wherein said first reference current generator comprises:

a first PMOS transistor comprising a source connected to a supply voltage;

a second PMOS transistor comprising a source connected to said supply voltage and a gate and a drain connected to a gate of said first PMOS transistor;

a third PMOS transistor comprising a source connected to a drain of said first PMOS transistor;

a fourth PMOS transistor comprising a source connected to the drain of said second PMOS transistor and a gate and a drain connected to each other;

a first NMOS transistor comprising a source and a gate connected to a drain of said third PMOS transistor;

a second NMOS transistor comprising a source connected to the drain of said fourth PMOS transistor and a gate connected to the gate of said first NMOS transistor;

a third NMOS transistor comprising a source and a gate connected to a drain of said first NMOS transistor;

a fourth NMOS transistor comprising a source connected to a drain of said second NMOS transistor and a gate connected to the gate of said third NMOS transistor;

a first bipolar transistor comprising a base and a collector connected to a drain of said third NMOS transistor and an emitter connected to a ground; and a first load between a drain of said fourth NMOS transistor and the ground, said first load configured to have said first reference current flow therein.

5. The apparatus of claim 4, wherein said second reference current generator comprises:

a fifth PMOS transistor comprising a source connected to said supply voltage;

a second bipolar transistor comprising a collector connected to a gate and a drain of said fifth PMOS transistor and a base connected to the base of said first bipolar transistor, the collector configured to have said second reference current flow therein;

a second load between the emitter of said second bipolar transistor and the ground; and a sixth PMOS transistor comprising a source connected to said supply voltage, a gate connected to the gate of said fifth PMOS transistor and a drain connected to said second current mirror.

6. The apparatus of claim 5, wherein the second element is adjustable by a ratio of said first load to said second load.

7. The apparatus of claim 5, wherein said first current mirror comprises:

a seventh PMOS transistor comprising a gate connected to the drain of said second PMOS transistor and a source connected to said supply voltage; and an eighth PMOS transistor comprising a source connected to a drain of said seventh PMOS transistor, a gate connected to the drain of said fourth PMOS transistor and a drain connected to said second current mirror, the drain of said eighth PMOS transistor configured to have said first reference current flow therein.

8. The apparatus of claim 7, wherein said second current mirror comprises:

a fifth NMOS transistor comprising a source and a gate connected to said addition result and a drain connected to the ground; and a sixth NMOS transistor comprising a gate connected to the gate of said fifth NMOS transistor, a source configured to have said output reference current flow therein and a drain connected to the ground.

* * * * *